US005720312A

United States Patent [19]

Scheuermann

[11] Patent Number: 5,720,312

[45] Date of Patent: Feb. 24, 1998

[54] COLLAPSIBLE SHELTER, AND METHODS OF CONSTRUCTING AND UTILIZING SAME

[75] Inventor: Chris Scheuermann, 51 Walker Rd. South, Box 700 R.R. #2, Thessalon Ontario, Canada, P0R 1L0

[73] Assignee: Chris Scheuermann, Thessalon, Canada

[21] Appl. No.: 453,976

[22] Filed: May 30, 1995

[51] Int. Cl.[6] ..... E04H 15/06

[52] U.S. Cl. ..... 135/88.09; 52/3; 52/653.2; 52/656.1; 52/DIG. 14; 135/88.03; 135/88.13; 135/96; 135/127; 135/138; 135/901; 180/190

[58] Field of Search ..... 52/3, 23, 653.2, 52/656.1, 656.9, DIG. 14; 135/88.01, 88.03, 88.09, 88.13, 96, 117, 124, 127, 133, 135, 137, 141, 88.15, 125, 128, 138, 901; 180/190; 403/109, 379

[56] References Cited

U.S. PATENT DOCUMENTS

| | | | |
|---|---|---|---|
| 952,879 | 3/1910 | Crocker | 135/141 |
| 1,214,979 | 2/1917 | Von Ahnen | 135/141 |
| 1,454,395 | 5/1923 | McDonald . | |
| 1,918,423 | 7/1933 | Persinger | 52/3 X |
| 1,984,681 | 12/1934 | Jackson . | |
| 2,277,020 | 3/1942 | Lynn | 135/141 |
| 2,737,397 | 3/1956 | Turner . | |
| 3,051,185 | 8/1962 | Reynolds | 135/124 |
| 3,464,735 | 9/1969 | Smith | 135/117 X |
| 3,599,740 | 8/1971 | Martinmaas | 180/190 |
| 3,698,409 | 10/1972 | Koontz et al. | 135/117 X |
| 3,820,805 | 6/1974 | Tuomala . | |
| 3,971,395 | 7/1976 | Lipinski | 135/901 X |
| 4,106,145 | 8/1978 | Gillen et al. | 135/901 X |
| 4,778,214 | 10/1988 | Fu | 135/88.01 X |
| 5,186,513 | 2/1993 | Strother | 135/88.09 X |
| 5,238,014 | 8/1993 | Cai | 135/124 X |
| 5,259,821 | 11/1993 | Bryant | 403/109 X |
| 5,353,826 | 10/1994 | Davis, Sr. | 135/88.13 |
| 5,458,079 | 10/1995 | Matthews et al. | 135/901 X |

FOREIGN PATENT DOCUMENTS

| | | | |
|---|---|---|---|
| 1928653 | 12/1970 | Germany | 135/138 |
| 946315 | 1/1964 | United Kingdom | 135/137 |

*Primary Examiner*—Wynn E. Wood
*Assistant Examiner*—Kevin D. Wilkens
*Attorney, Agent, or Firm*—Weiner, Carrier, Burt & Esser, P.C.; William F. Esser; Joseph P. Carrier

[57] ABSTRACT

A collapsible and portable fishing shelter or survival unit for use in conjunction with a snowmobile. The snowmobile acts as the base for the unit, and adds stability to it. Structural members are releasably secured to the snowmobile, and a tarp covering is placed over the structural members to form the collapsible shelter. The seat or seats of the snowmobile form the seats of the collapsible shelter. The shelter may be erected at one location, and moved by the snowmobile to a new location.

16 Claims, 4 Drawing Sheets

COLLAPSIBLE SHELTER, AND METHODS OF CONSTRUCTING AND UTILIZING SAME

BACKGROUND OF THE INVENTION

1. Field of the Invention

The present invention relates generally to collapsible shelters, and methods of constructing and utilizing same. Particularly, the invention relates to a portable hut which can be transported anywhere a snowmobile can go.

2. Description of the Relevant Art

Ice fishing for extended periods of time is more comfortable when carried on from within a shelter or portable hut. However, because of the remote locations of some fishing grounds, the transporting of a suitable shelter to the fishing grounds presents considerable problems. Because of this and other reasons, a number of knock-down shelter/sled combinations and portable shelters with runners have been suggested which permit transportation to the desired locale and which enable relatively rapid erection of the shelter.

However, such devices of the prior art suffer from a number of important disadvantages. Many of the sled designs are unsuitable for use in heavy snow and over rugged terrain. Others are too complicated to appeal to the prospective user.

None of the previous devices and techniques have provided a simple construction and assembly which would enable the erection of a collapsible shelter and its transportation to the desired locale with a minimum of effort. Indeed, a desideratum the present invention is to avoid the animadversions of the previous devices and techniques. It would thus be desirable to provide a construction and system which, in addition to eliminating the aforementioned problems and disadvantages of the previous techniques, provides very new and desirable features hereinbefore unattainable.

SUMMARY OF THE INVENTION

The present invention provides a collapsible shelter comprising, in combination, a plurality of support members for releasable securement to a snowmobile. One or more cover members are provided for releasable securement to the plurality of support members and/or the snowmobile to form a collapsible shelter releasably interconnected with the snowmobile.

It is an object of the present invention to provide a collapsible fishing hut and/or survival unit which can be transported anywhere a snowmobile can go.

Another object of the invention is to provide a collapsible shelter which can be set up easily and quickly, and which the wind will not blow over.

It is another object of the invention to provide a collapsible shelter wherein the snowmobile functions as the base of the shelter and provides added stability.

It is another object of the invention to provide a collapsible shelter in combination with a snowmobile whereby the snowmobile can be moved short or long distances with the collapsible shelter partially or completely assembled.

Other objects, advantages, and applications of the present invention will become apparent to those skilled in the art when the accompanying description of some examples of the best modes contemplated practicing the invention is read in conjunction with the accompanying drawings.

DESCRIPTION OF SOME PREFERRED EMBODIMENTS

Figure 1:
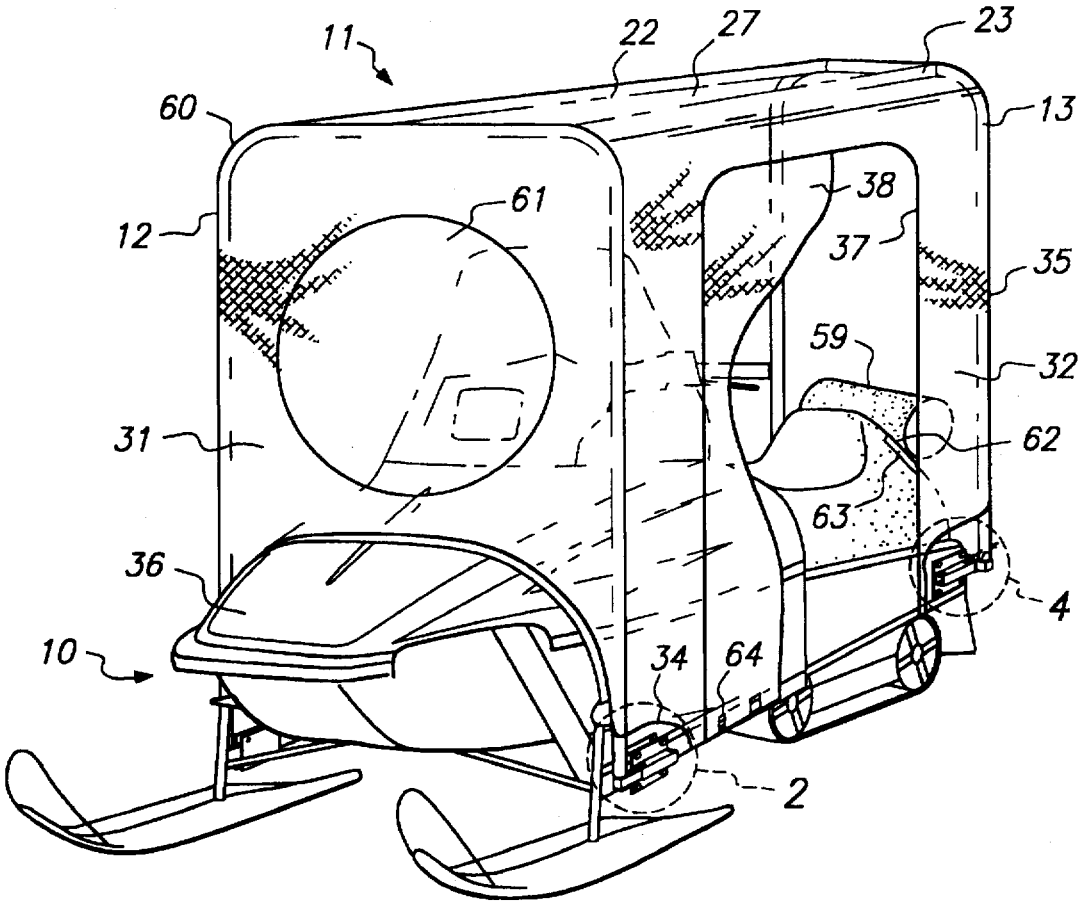
FIG. 1 illustrates a perspective drawing of a first embodiment of the present invention.

The description herein makes reference to the accompanying drawings wherein like reference numerals refer to like or equivalent parts.

Figure 6:
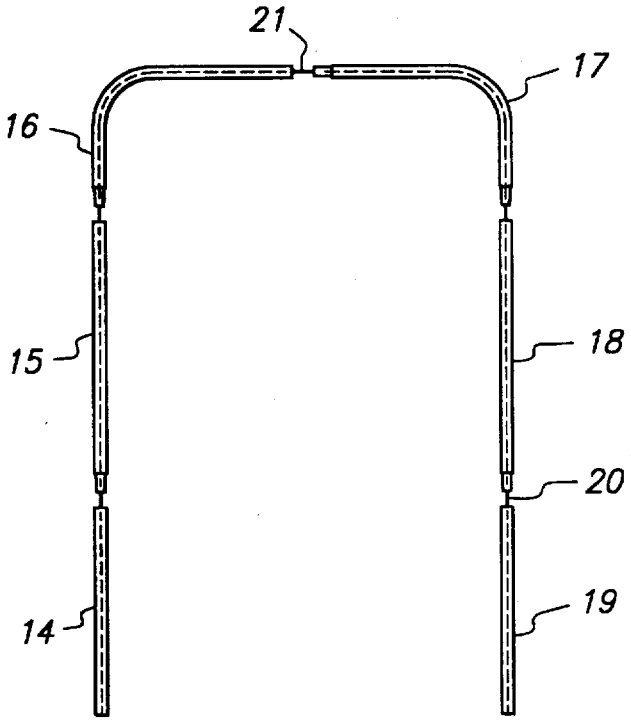
FIG. 6 illustrates a disassembled view of a front or back U-shaped support member.

FIG. 1 shows a conventional snowmobile 10 with a collapsible shelter 11 releasably secured thereto. With reference to FIGS. 1 and 6, there is shown a from substantially U-shaped support member 12 and a back substantially U-shaped support member 13.

With reference to FIG. 6, it should be noted that the U-shaped support members 12 and 13 are each formed of separable and interlocking support sections 14, 15, 16, 17, 18 and 19 which have tapered ends 20 to ease in fitting together. It should also be noted that all of the support members 12 and 13 are provided with a shock cord 21 which runs through all of the separate interlocking sections 14, 15, 16, 17, 18 and 19 for ease of setting up and removal.

Figure 7:
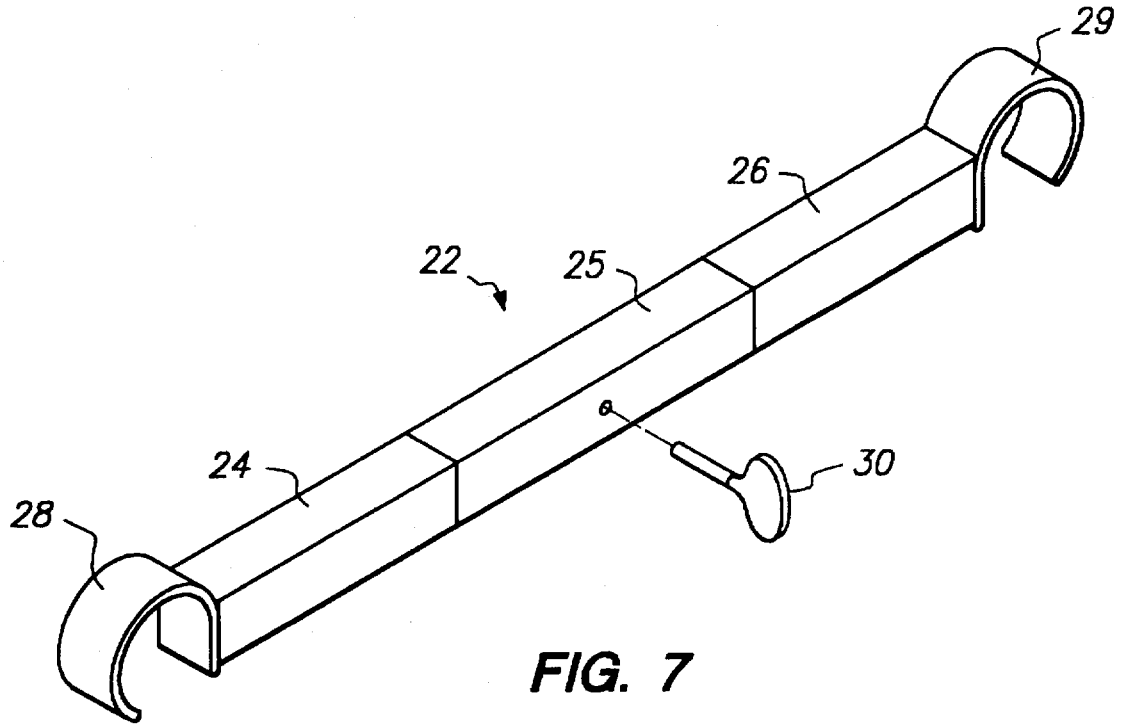
FIG. 7 illustrates an adjustable intermediate support member.
Figure 8:
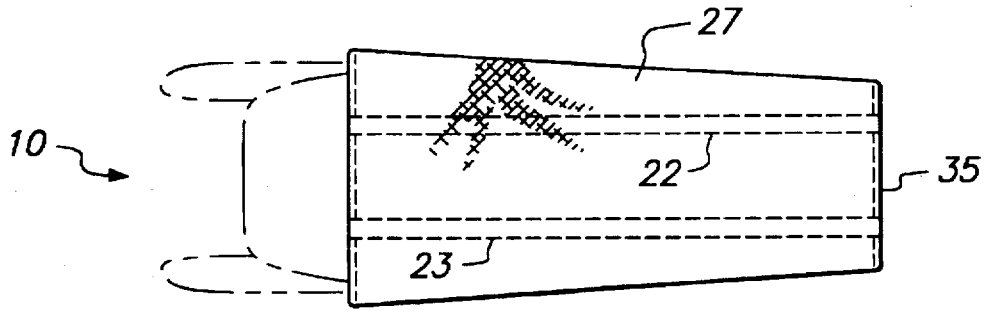
FIG. 8 illustrates a top plan view of the collapsible shelter as assembled.

The U-shaped support members 12 and 13 are connected together with a pair of intermediate support members 22 and 23 which are shown in FIGS. 1, 7 and 8. As best seen in FIG. 7, each intermediate support member 22 or 23 is made up of expandable sections 24, 25 and 26 which can be telescopically expanded to tighten the cover 27 of the collapsible shelter 11. Clips 28 and 29 are provided to cooperate with the top portions 16 and 17 of the U-shaped support members 12 and 13. Each intermediate support member 22 and 23 is provided with a key 30 for locking the member 22 or 23 in its desired expanded position.

As shown in FIG. 1, the collapsible shelter 11 is provided with a cover 27 having one or more cover member sections 31, 32 and 35 for releasable securement to the support members 12, 13 and 33 or to support members 12, 13, and 33 and snowmobile. The cover member section 31 is provided with an elastic drawstring 34 for tightening the cover 27 over the cowling 36 of the snowmobile 10. The collapsible shelter 11 may be provided with a side opening 37 with or without an enclosure door 38.

Figure 2:
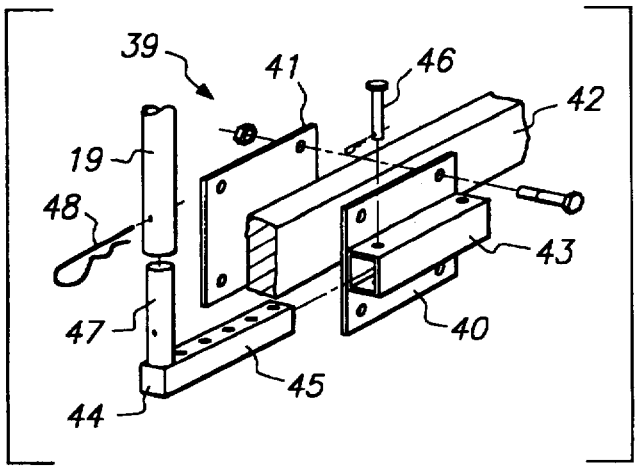
FIG. 2 illustrates on an enlarged scale one embodiment of a front bracket mechanism, circled in phantom line 2 shown in FIG. 1.

With reference to FIG. 2, front bracket means 39 includes a front bracket 40 and bracket plate 41 secured to a portion of the snowmobile 10, such as the snowmobile trailing arm 42, to provide a socket 43 for mounting the front U-shaped member 12. An L-shaped bracket member 44 has a horizontal portion 45 for fitting with the square socket 43 for adjustable securement thereto by way of a pin 46. The L-shaped member 44 is also provided with an upstanding male member 47 for receiving the tubular portion 19 of the U-shaped member 12 for securement thereto by way of a removable latch pin or litch pin 48.

Figure 3:
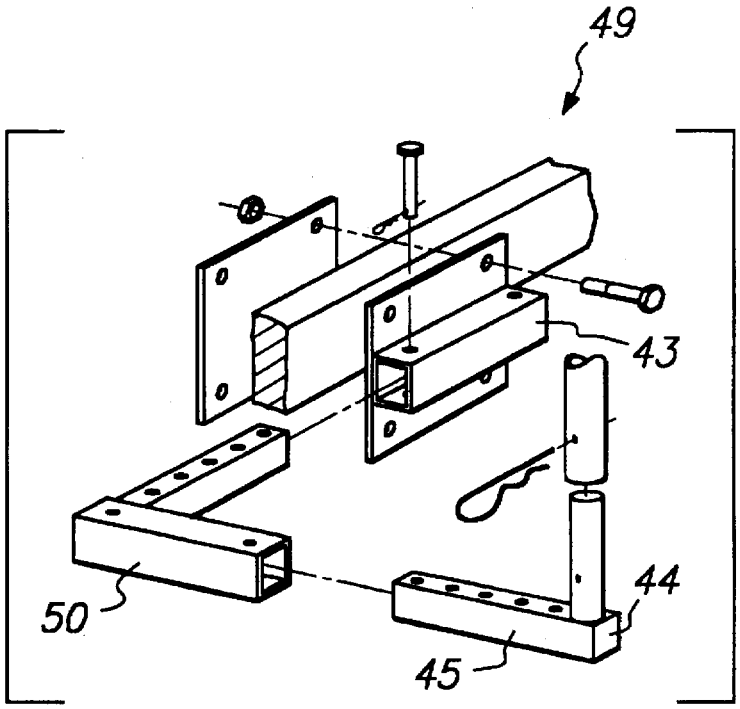
FIG. 3 illustrates an alternative embodiment of the front bracket mechanism.

The mechanism 49 of FIG. 3 is somewhat similar to the FIG. 2 bracket mechanism 39, but the FIG. 3 mechanism 49 is employed when it is desired to increase the width dimension of the front U-shaped support member 12. The FIG. 3 mechanism 49 includes an additional L-shaped member 50 for mating with a square socket 43 as well as for receiving the horizontal member 45 of the L-shaped bracket member 44.

Figure 4:
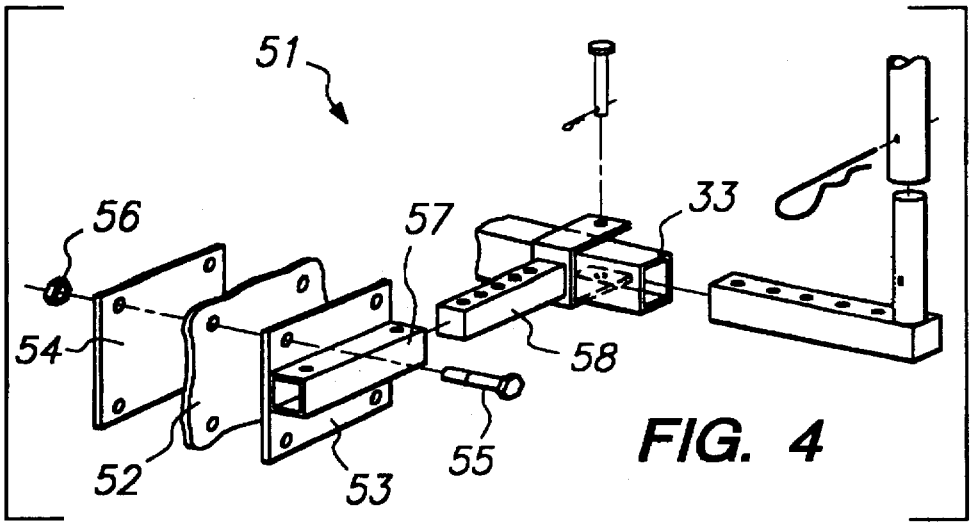
FIG. 4 illustrates on an enlarged scale a back bracket mechanism and a fragmentary portion of a width adjustment support member, circled in phantom line 4 shown in FIG. 1.
Figure 5:
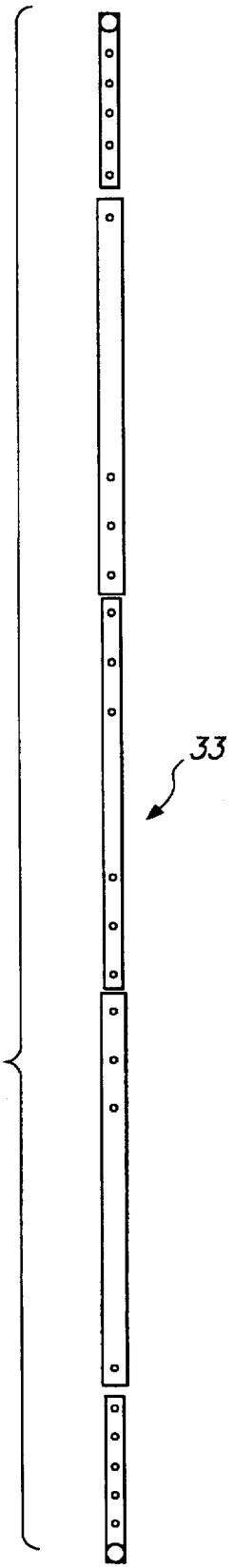
FIG. 5 illustrates a top plan view of a disassembled width adjustment support member.

Because snowmobiles come in various width dimensions, with typically a narrow width dimension towards the rear, special provisions have been made for this situation. FIG. 4 shows the back mounting bracket means or mechanism 51 wherein a tunnel plate member 52 of the snowmobile 10 is sandwiched between an outer bracket member 53 and a back plate member 54 with suitable bolts 55 and nuts 56. The outer back bracket 53 is provided with a square socket 57 within which may be placed a fork shaped member 58. The fork-shaped member 58 accommodates an expandable and adjustable for providing the desired adjustable width dimension of the back U-shaped support 13. The width adjustment support member 33 is shown in its entirety in FIG. 5, and partially in FIG. 4. Preferably, but not necessarily, the width adjustment support member 33 can be adjusted from 16" to 22".

It should also be appreciated that some of the bracket components can be left permanently affixed to the snowmobile if desired.

In a typical arrangement, the width of the front U-shaped member 12 would be approximately 38", and the width of the back U-shaped member would be approximately 20".

All of the support members 12, 13, 22, 23 and 33 can be disassembled into sections no longer than 20" for fitting within a appropriately dimensioned carrying case 59. The carrying case 59 is shown in FIG. 1 and it is provided with means for affixing the carrying case 59 the rear portion of the snowmobile 10. It is contemplated that all of the sections comprising the support members, the cover member 27, and any other hardware parts can be easily accommodated within the carrying case 59. Preferably, but not necessarily, it is contemplated that the carrying case 59 be 22" long and approximately 9" in diameter. It is also contemplated that the carrying case 59 be provided with a full length opening with a zipper or velcro. If desired, the carrying case 59 may be strapped to the front or back of the snowmobile seat back, or releasably affixed thereto by means, such as velcro strips 62 and 63.

FIG. 8 shows a top view of the assembled collapsible shelter 11, and gives a good idea of the substantially trapezoidal shape of the top portion of the shelter 11.

It should be noted that the shelter 11 is provided with a slightly rounded top 60 which provides distinct advantages with respect to precipitation as well as wind.

The present invention contemplates that the support members 12, 13, 22, 23 and 33 can be installed at one location, and thereafter the snowmobile 10 with the assembled support members moved to a new desired location. At the new desired location the cover member 27 can be put on to complete the collapsible shelter 11.

Alternatively, the present invention contemplates that the support members can be erected at a first location with all of the cover member sections except for the front cover member section 31 being in place and the snowmobile with its assembled parts moved to the new location.

The present invention also contemplates the use of the front cover member section 31 being completely fabricated from transparent plastic or other material so that with the cover completely assembled the operator of the snowmobile can drive the collapsible shelter to the desired location in its completely assembled condition and still have visibility to operate the snowmobile.

Another embodiment contemplates the use of a transparent window 61 in the front cover member section 31 as shown in FIG. 1.

It should also be appreciated that the single or double seat of the snowmobile provides the seating for the collapsible shelter.

It should also be appreciated that the invention provides a suitable survival unit in case of an emergency.

The cover or tent portion can be provided with a plurality of elastic tie down tabs 64 as shown in FIG. 1 for securement to the snowmobile or the support members.

While the foregoing has described the features and advantages of several embodiments of the present invention, it will be apparent to those skilled in the art that changes in form and proportion and minor details of construction may be resorted to without departing from the spirit of the present invention or the scope of the appended claims.

I claim:

1. A collapsible shelter comprising, in combination:

a plurality of support members;

means for releasably securing said support members along a longitudinal side of a snowmobile;

one or more soft cover members for releasable securement over said plurality of support members in order to form a collapsible shelter releasably interconnected with the snowmobile;

a means for selectively adjusting a length and a width of said shelter;

said width adjusting means includes a means for selectively adjusting a width of a back portion of said shelter relative to a width of a front portion thereof said releasable securing means comprises:

front bracket means for releasably securing at least one of said plurality of support members to a front portion of the snowmobile;

back bracket means for releasably securing at least one of said plurality of support members to a back portion of the snowmobile;

means for adjusting said securement of said support members to each of said front bracket means and said back bracket means; and said securement adjusting means adjusts securement of said support members in longitudinal and lateral directions.

2. A collapsible shelter according to claim 1, wherein:

said plurality of support members includes a front substantially U-shaped support member for releasable securement to a front portion of the snowmobile, and a back substantially U-shaped support member for releasable securement to a back portion of the snowmobile; and said releasable securing means includes one or more pin members adapted to release engagement of said support members from the snowmobile when said pin members are withdrawn from said securing means; and said length adjusting means includes one or more pin members which substantially locks said support members in position when selectively engaged therewith.

3. A collapsible shelter according to claim 2, including:

one or more intermediate support members releasably secured between said front substantially U-shaped support member and said back substantially U-shaped support member;

said one or more intermediate support members is secured in a substantially fixed position between said substantially U-shaped members when secured therewith; and a length of said one or more intermediate support members is adjustable.

4. A collapsible shelter according to claim 3, wherein: each said support member is formed from separable and interlocking support sections; and including a carrying case for enclosing and carrying said support sections and said cover members when said collapsible shelter is in an unassembled condition; and means for affixing said carrying case to a rear portion of said snowmobile.

5. A collapsible shelter according to claim 2, wherein:

each said support member is formed from separable and interlocking support sections; and including a carrying case for enclosing and carrying said support sections and said cover members when said collapsible shelter is in an unassembled condition; and means for affixing said carrying case to a rear portion of said snowmobile.

6. A collapsible shelter according to claim 1, wherein:

each said support member is formed from separable and interlocking support sections; and including a carrying case for enclosing and carrying said support sections and said cover members when said collapsible shelter is in an unassembled condition; and means for affixing said carrying case to a rear portion of said snowmobile.

7. A collapsible shelter according to claim 6, wherein:

each of said interlocking sections of said support members includes a tapered end and an untapered end, with said tapered end being sized for telescopical insertion within an untapered end of another of said interlocking section.

8. A collapsible shelter according to claim 1, wherein:

said shelter width adjusting means facilitates said shelter having a substantially trapezoidal shape from a top plan view thereof.

9. A collapsible shelter comprising, in combination:

a front substantially U-shaped support member;

a back substantially U-shaped support member;

front bracket means for releasably securing said front substantially U-shaped support member along a front, side portion of a snowmobile;

back bracket means for releasably securing said back substantially U-shaped support member along a back, side portion of the snowmobile;

a width adjustment support member interconnected with said back bracket means and said back substantially U-shaped support member for adjustably and releasably selecting a desired width dimension for said back substantially U-shaped support member;

shock cord means disposed through said front substantially U-shaped support member and said back substantially U-shaped support member to facilitate assembly of each;

one or more soft cover members for releasable securement over said support members;

means, interconnected with said substantially U-shaped support members, for adjustably selecting a desired length dimension for said shelter.

10. A collapsible shelter according to claim 9, wherein:

said one or more soft cover members includes an opening defined along a side portion of said shelter, for providing access to occupants of said snowmobile.

11. A shelter according to claim 9, further including:

means, interconnected with said substantially U-shaped support members, for adjustably selecting a desired length dimension for said shelter; and said length selecting means comprises at least one intermediate support member which is releasably secured between said substantially U-shaped support members and which is telescopically adjustable.

12. A collapsible according to claim 9, wherein:

said front bracket means includes at least one pin member adapted to engage said front substantially U-shaped support member to the snowmobile; and said back bracket means includes at least one pin member adapted to engage said back substantially U-shaped support member to the snowmobile.

13. A collapsible shelter as recited in claim 9, wherein:

said width adjustment support member allows for adjustment of a width of said back support member relative to a width of said front support member.

14. A shelter according to claim 9, further including:

means, interconnected with said substantially U-shaped support members, for adjustably selecting a desired length dimension for said shelter.

15. A collapsible shelter according to claim 9, further including:

means for adjusting said securement of said U-shaped support members to each of said front bracket means and back bracket means, said securement adjusting means adjusts securement of said U-shaped support members in longitudinal and lateral directions.

16. A collapsible shelter comprising, in combination:

a plurality of support members;

means for releasably securing said support members along a longitudinal side of a snowmobile;

one or more soft cover members for releasable securement over said plurality of support members in order to form a collapsible shelter releasably interconnected with the snowmobile;

a means for selectively adjusting a length and a width of said shelter;

said width adjusting means includes a means for selectively adjusting a width of a back portion of said shelter relative to a width of a front portion thereof;

each said support member is formed from separable and interlocking support sections;

a carrying case for enclosing and carrying said support sections and said one or more cover members when said collapsible shelter is in an unassembled condition;

means for affixing said carrying case to a rear portion of the snowmobile; and each of said interlocking sections of said support members includes a tapered end and an untapered end, with said tapered end being sized for telescopical insertion within an untapered end of another of said interlocking section.

* * * * *